US006840693B1

(12) United States Patent
Bell

(10) Patent No.: US 6,840,693 B1
(45) Date of Patent: Jan. 11, 2005

(54) ATTACHABLE SUSPENDED BAR SOAP HOLDER APPARATUS

(75) Inventor: Andrea Darlene Bell, Estero, FL (US)

(73) Assignee: Andrea Bell, Estero, FL (US)

( * ) Notice: Subject to any disclaimer, the term of this patent is extended or adjusted under 35 U.S.C. 154(b) by 0 days.

(21) Appl. No.: 10/655,709

(22) Filed: Sep. 6, 2003

Related U.S. Application Data

(60) Provisional application No. 60/413,827, filed on Sep. 26, 2002.

(51) Int. Cl.[7] ..... A47K 7/02; A46B 11/00; B43K 23/02

(52) U.S. Cl. ..... 401/201; 401/48; 401/131

(58) Field of Search ..... 401/196, 201, 401/48, 131

(56) References Cited

U.S. PATENT DOCUMENTS 618,943 A * 2/1899 Kahnweiler ..... 401/201
1,292,982 A * 1/1919 Wolf ..... 401/266
2,363,697 A * 11/1944 Schirmer ..... 401/7
3,167,805 A * 2/1965 Zuppinger et al. ..... 401/201
4,228,834 A * 10/1980 Desnick ..... 383/13
4,480,939 A 11/1984 Upton
4,913,319 A 4/1990 Root
5,031,759 A 7/1991 Ogilvie
5,207,725 A * 5/1993 Pinkerton ..... 383/24
5,642,871 A 7/1997 Repert et al.
6,048,407 A 4/2000 Schoch

* cited by examiner

*Primary Examiner*—David J. Walczak

(57) ABSTRACT

An attachable suspended bar soap holder apparatus for applying bar soap to skin or other bathing device during the bathing process that provides a better grip on the soap and inhibits the soap from falling away from the users reach thus eliminating the need to bend to retrieve soap when it falls on the floor. The device comprises of a circumferential body having a strap attached thereto and further comprising closures and a cord connected to the strap. The strap can be attached to a grab bar, shower door rail, base of a shower chair arm or any other stable surface. A porous casing is also attached to the body which allows for application of soap onto skin or other bathing device. The porous casing can stretch to reach any body part and provides a better grip on bar soap plus inhibits soap from falling away from the users reach.

3 Claims, 1 Drawing Sheet

ATTACHABLE SUSPENDED BAR SOAP HOLDER APPARATUS

CROSS-APPLICATIONS

Figure 1:
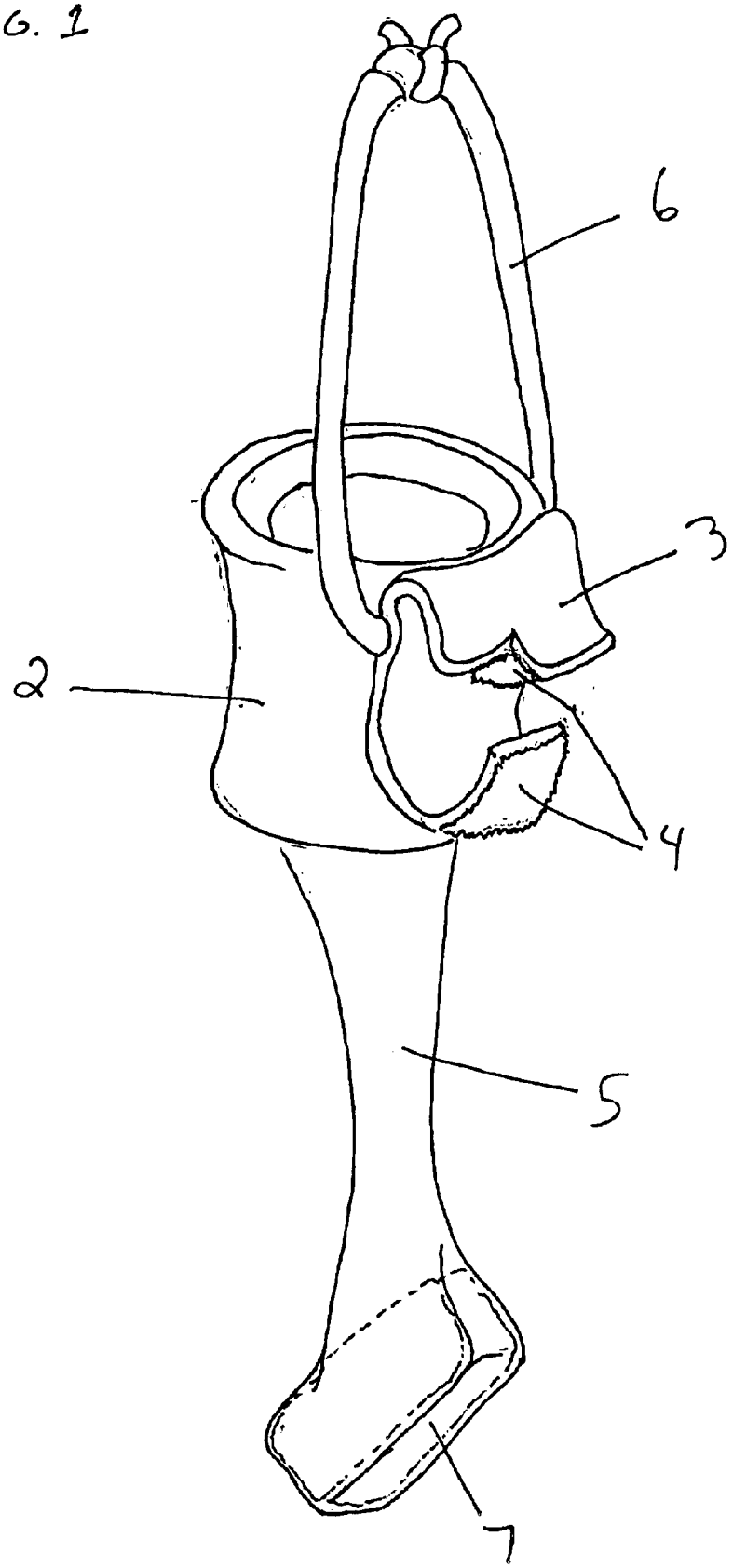

This Application claims benefit of Provisional No. 60/413,827 Filling Date Sep. 26, 2002.

FEDERALLY SPONSORED RESEARCH

Not Applicable

SEQUENCE LISTING OR PROGRAM

Not Applicable

1. Field of Invention

This invention relates to soap holders, specifically to such soap holders that are used in the shower or bath to inhibit bar soap from falling onto the shower floor or out of the users reach while in use and provides the user a textured grip on a bar of soap.

2. Background of the Invention

It is frequently necessary for an individual to apply bar soap to their body during a shower or bath. For many people handling the soap and retrieving the soap when it falls onto the floor is a difficult task often requiring assistance by another person to retrieve the soap when it falls onto the shower floor. Also, many elderly or disabled individuals have difficulty bending, handling and retrieving their soap during the bathing process. For many individuals especially those with limitations, attempting to retrieve their dropped soap while bathing is difficult or dangerous. Therefore there is a need for an, implement to increase the ease of handling bar soap and eliminating the chance for the soap to fall onto the floor out of reach thus increasing safety during the bathing process.

Thereafter, inventors created several types of devices to encase or inhibit soap from falling onto the floor.

U.S. Pat. No. 5,031,759 to Ogilive (1991) discloses a water pervious bag for holding a bar of soap for washing a person's body, the bag comprising a sleeve of synthetic yarn knitted with a wide loose weave. The bag is closed at one end and open at the other end with releasable closing means at said other end. However, although the bar of soap is encased, it is useless for inhibiting soap from falling onto the floor. U.S. Pat. No. 4,480,939 discloses a soap holder and dispenser suitable for installation and use in the shower. It includes a pouch formed from synthetic netting material sized to receive a bar of soap and a hanger with a hook, which supports the pouch in the shower. The pouch has a pocket for the soap and a pair of integral flaps extending upwardly away from the pocket walls. The outer ends of the flaps are fastened together and provided with an eyelet of a size to fit the hook so the pouch can be hung. The hook is integral with a shaft mounted in a plastic base designed for attachment to the shower wall with a suitable adhesive. Although the soap is suspended in a pouch, it does not stretch and must be removed from the plastic base to be used to reach all body parts. When the pouch is removed from the base to which it is attached, the soap can fall on the floor.

Several types of devices for suspending soap have been proposed-for example, in U.S. Pat. No. 4,913,319 to Root (1990) and U.S. Pat. No. 5,642,871 to Repert et al. (1997). Although the soap is suspended, both devices are mounted either to the wall or to a device that first must be mounted into or onto the wall. Both devices are somewhat time-consuming to install and would be difficult for an elderly or disabled person to install, manipulate and to attach soap to the devices.

Nevertheless, all of the suspended soap holders heretofore known suffer from a number of disadvantages:

(a) The devices must be attached to another device that must first be mounted into or onto the wall.

(b) One must have good motor skills and strength to attach, assemble and use the devices which many disabled or elderly people do not have.

(c) Some parts of the devices are bulky or sharp and may inflict injury if contacted with frail skin.

(d) One must have good strength and fine motor skills to manipulate parts of the devices.

(e) Devices not attached while in use can still fall onto the floor and the user would have to bend to retrieve the soap.

OBJECTS AND ADVANTAGES

Accordingly, several objects and advantages of the present invention are:

(a) to provide a device that is easy to install and attaches by a cord or Velcro™.

(b) to provide a device that can be used over and over again with any size of bar soap.

(c) to provide a device that is made of mildew resistant material and is machine washable.

(d) to provide a device that has no metal parts that can rust.

(e) to provide a device that can be easily used by the elderly and disabled population without risk of injury.

(f) to provide a device that can be attached by a sturdy Velcro™ strap or cord to a variety of stable surfaces in the shower or bathing area such as a grab bar, shower door rail, base of shower chair armrest, or other surface where attachment is safely available.

(g) to provide a device that can be safely used for bathing by anyone at most locations to include the shower, bathtub, boat, campground or other locations.

(h) to provide a device that can-stretch so the bather can reach all body parts with their soap in the suspended casing.

(i) to provide a device that will provide a way to retrieve the soap without bending should it fall out of the users hand while it is in use.

(j) to provide a device that will increase a person with limitations or who is disabled to be more independent during the bathing process.

(k) to provide a device that soap can suds right through the porous casing.

SUMMARY

In accordance with the present invention an attachable suspended bar soap holder apparatus comprises a circumferential body to which are attached a strap with Velcro™ closures, a porous casing or sleeve, and a cord.

DRAWINGS—FIGURES

Further objects and advantages of the invention will become apparent from the following description and claims, and from the accompanying drawings, wherein:

FIG. 1 is an isometric view that clearly displays all parts of the invention attachable suspended soap holder apparatus.

For the purposes of this disclosure, the following Drawing Reference Numerals are used in reference to the Figure.

2 body of apparatus
3 strap
4 Velcro™ closures
5 Porous stretchable casing
6 Cord
7 Example of a bar of soap in the present invention

DETAILED DESCRIPTION

The present invention is described with reference to the attached FIG. 1. Referring to the drawing, the body 2 is a hollow circumferential shape made of mildew and mold resistant materials that have a strap 3 attached. On the ends of the strap 3 are placed Velcro™ closures 4 to which attach the present invention to a grab bar, shower door rail or base of a shower chair arm. Attached to the interior part of the body 2 and hanging down through the bottom opening of the body 2 is a porous stretchable casing 5. The porous stretchable casing 5 is open at the top and closed at the bottom thus allowing for easy insertion of a bar of soap 7. Attached to the underside of the strap 3 is a cord 6 that is to hang the attachable suspended soap holder apparatus from a stable surface when no grab bar, shower door rail or base of shower chair arm is available.

Thus, the mode of operation is for the user to open the Velcro™ closure (i.e., hook and loop type fasteners) 4 on the strap 3 wrap them around a grab bar, shower door rail or base of shower chair armrest and attach the Velcro™ closures to each other, which will secure the present invention in place. If there is no grab bar, shower door rail or shower chair armrest, the user would hang the present invention to a stable surface by the cord 6. The user then inserts a bar of their favorite soap into the opening of the porous casing 5 and pushes it all of the way to the bottom of the porous casing 5. The present invention is then ready for use. The porous casing 5 can be stretched to apply soap to the body, wash cloth or other bathing device. Soap suds come up right through the porous casing 5.

ADVANTAGES

From the description above, a number of advantages of the attachable suspended soap holder apparatus become evident:

(a) When soap is a sliver a new bar can be inserted right over the old one thus no more wasted soap.

(b) The present invention can be easily attached to a variety of different places within the shower or other desired bathing area within seconds with no tools.

(c) The present invention increases bathing independence for individuals with limitations or disabilities.

(d) The present invention is machine washable and made of mildew and mold resistant materials.

(e) The present invention is soft and cannot damage frail skin.

(f) The present invention can be easily moved for travel to other areas.

(g) The present invention can be used with any size bar or brand of soap.

(h) The present invention can be stretched to reach all body parts.

(i) The present invention makes holding onto a bar of soap easier and inhibits bar soap from falling on the floor while keeping it within easy reach of the user.

(j) The user will not have to bend to retrieve their soap if dropped when in use.

(k) The present invention promotes safety in the shower.

Accordingly, the reader will see that this invention will assist many elderly and disabled individuals to perform bathing and showering safer and with increased independence, can be easily attached into a shower or bathing area without tools, can be used over and over again with any bar of soap in a variety of bathing settings, is made of mold and mildew resistant materials and is machine washable. Furthermore, the present invention is made of soft materials and can be made in a variety of colors.

While specific embodiment of an improved attachable suspended soap holder apparatus has been disclosed in the foregoing description, it will be understood that various modifications within the spirit of the invention may occur to those skilled in the art. Therefore, it is intended that no limitations be placed on the invention except as defined by the scope of the appended claims.

What is claimed is:

1. A soap holder apparatus comprising:

a circumferential body having a top opening and a bottom opening;

a porous stretchable casing adapted to hold a bar of soap and having an open top attached to an interior portion of said body and a closed bottom wherein said casing extends through said bottom opening of said body and said closed bottom extends from said casing;

a strap attached to the side of said body and adapted to secure the soap holder to a support and a cord attached to said body and adapted to hang the soap holder from a support wherein when soap is positioned at said casing bottom and the soap holder is secured to a support by either said strap or cord, said casing can be stretched such that a user can reach all body parts with the soap in said casing.

2. The soap holder as defined in claim 1 wherein hook and loop type fasteners are positioned on said strap in order to enable the soap holder to be detachably secured to the support.

3. The soap holder as defined in claim 1 wherein the soap holder is machine washable and made from mold and mildew resistant materials.

* * * * *